United States Patent [19]

Sturdivant

[11] Patent Number: 4,823,728

[45] Date of Patent: Apr. 25, 1989

[54] VACUUM PAINTING APPARATUS

[76] Inventor: Jack L. Sturdivant, 17 Windermere La., Houston, Tex. 77063

[21] Appl. No.: 132,199

[22] Filed: Dec. 14, 1987

[51] Int. Cl.[4] ..... B05C 3/02

[52] U.S. Cl. ..... 118/50; 118/405

[58] Field of Search ..... 118/50, 404, 405; 427/434.7

[56] References Cited

U.S. PATENT DOCUMENTS

| | | | |
|---|---|---|---|
| 2,063,497 | 12/1936 | Geer | 118/405 X |
| 3,084,662 | 4/1963 | Badger | 118/404 X |
| 3,745,971 | 7/1973 | Story | 118/50 |
| 4,333,417 | 6/1982 | Camp et al. | 118/405 X |

*Primary Examiner*—John McIntosh

*Attorney, Agent, or Firm*—Browning, Bushman, Zamecki & Anderson

[57] ABSTRACT

A vacuum painting apparatus has movable entry and exit ports which compensate for bending or twisting of the strip material being painted. The entry and exit port templates are connected together by four compression struts. A spring-loaded slidable seal is provided around the periphery of each of the entry and exit port templates, sealing the templates to the box structure of the vacuum painting apparatus. The templates use either "Z" or "C" shaped parts each having first and second ends and a web therebetween, with one end having larger dimensions than the other end. A first set of guide roller assemblies is positioned at the entry port on the exterior of the apparatus, while a second set of guide roller assemblies is positioned at the exist port on the interior of the apparatus.

17 Claims, 8 Drawing Sheets

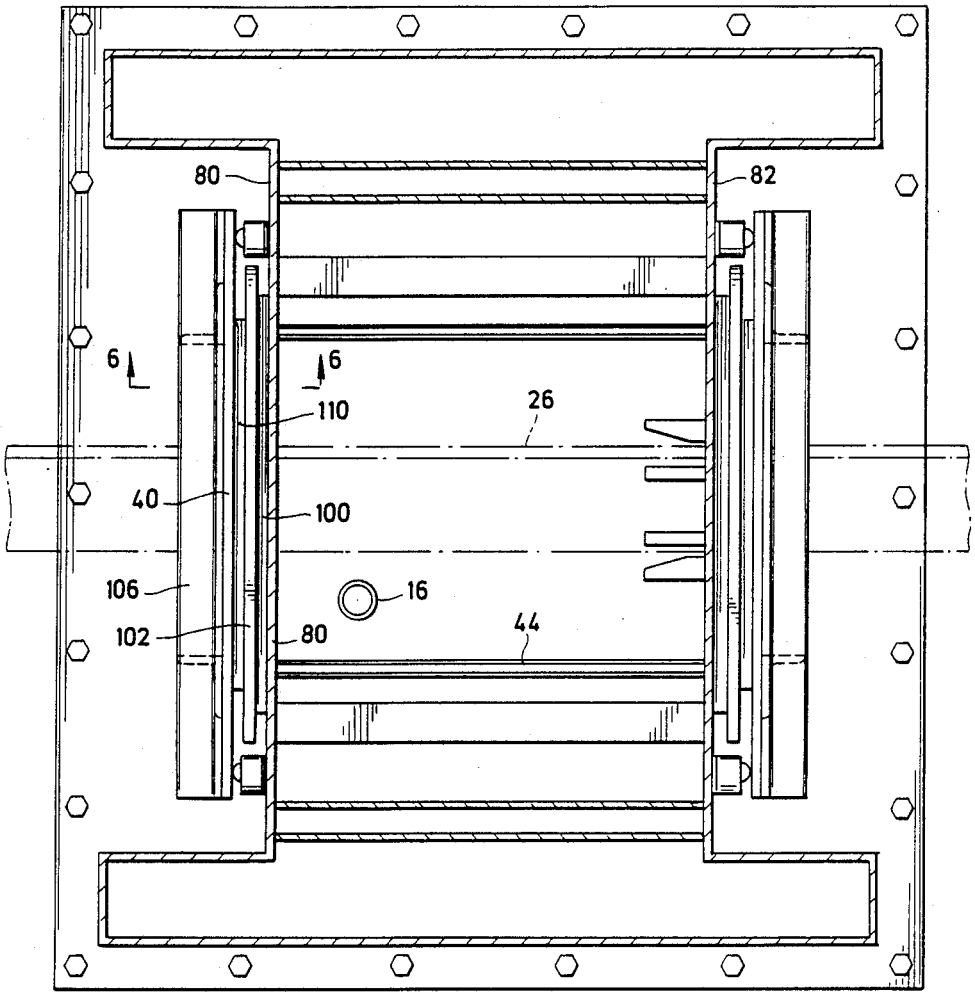
FIG. 5
FIG. 6
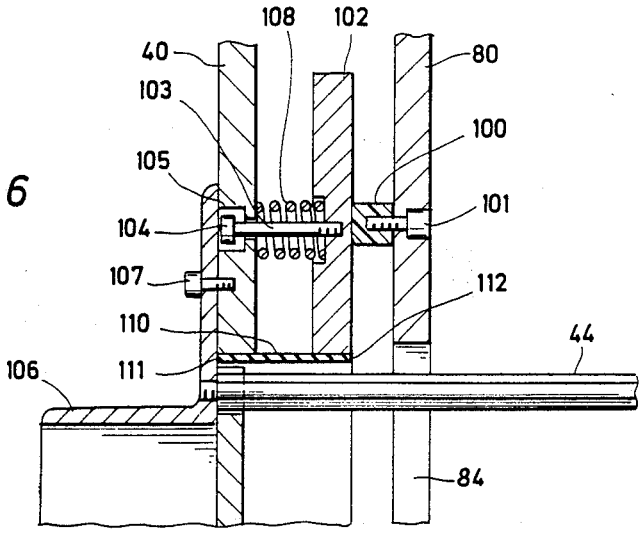

FIG. 7
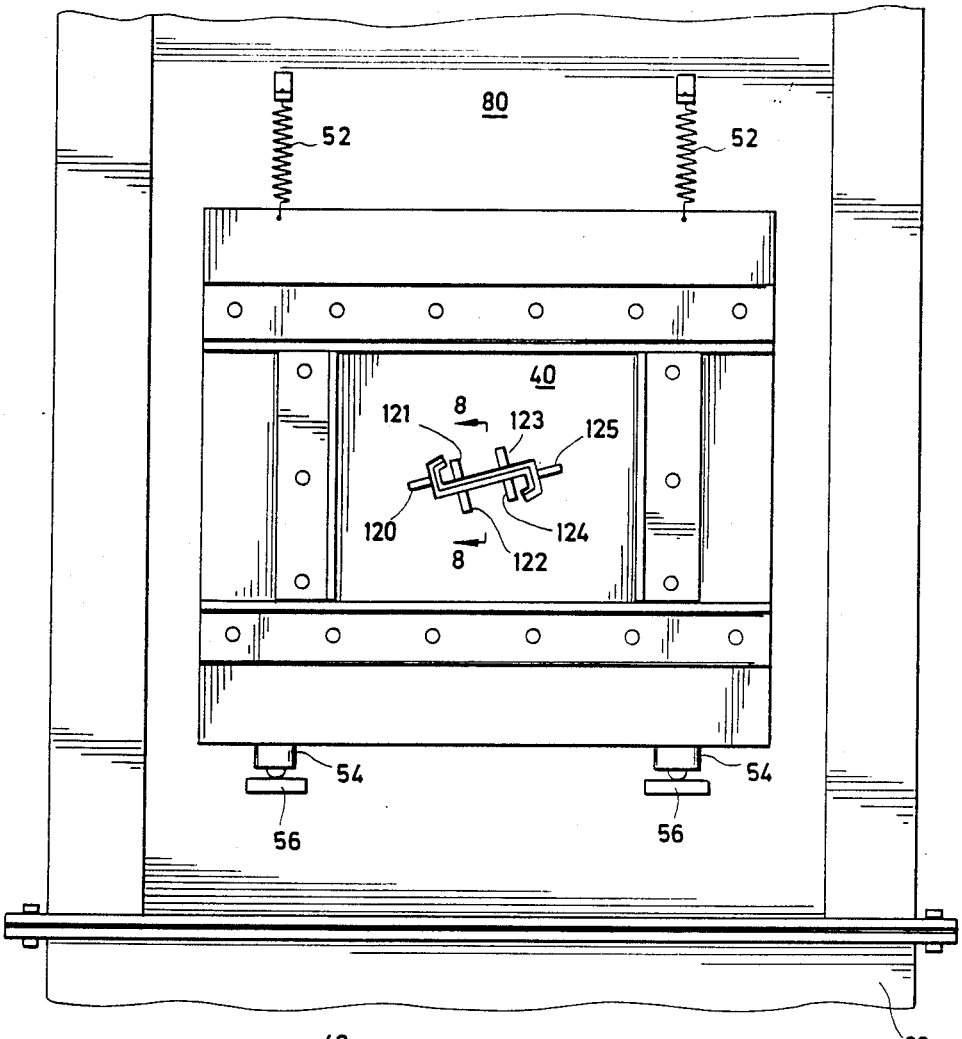
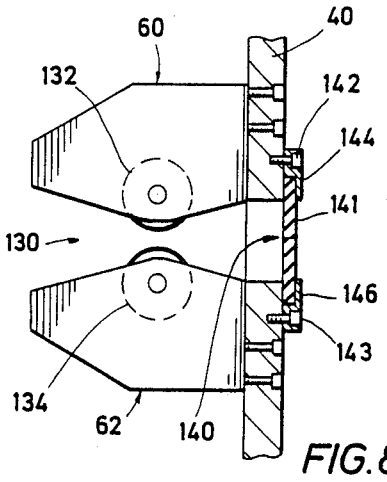
FIG. 8
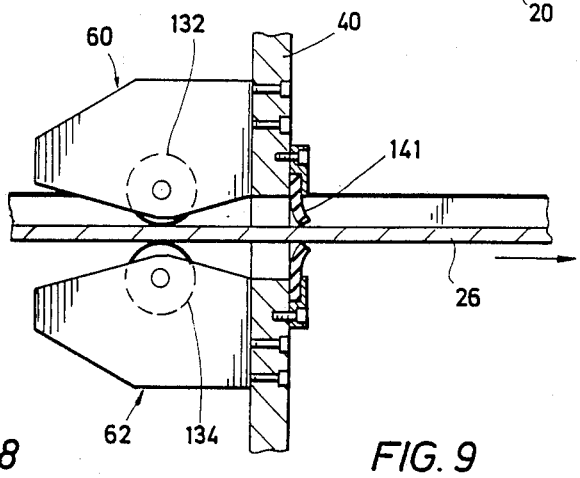
FIG. 9

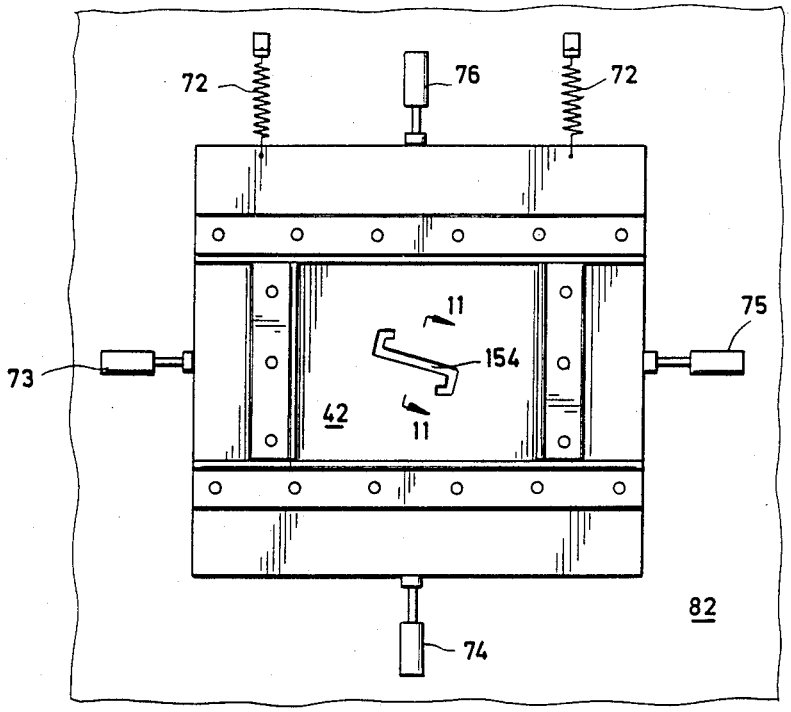
FIG. 10
FIG. 11
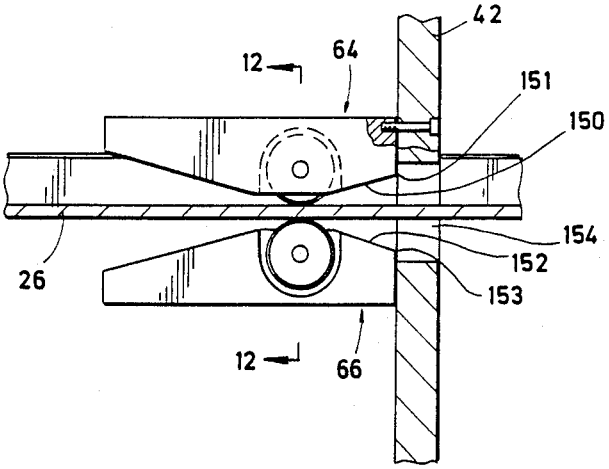
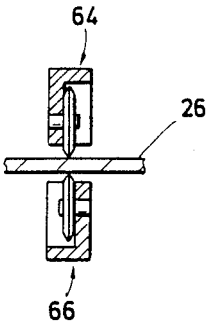
FIG. 12

VACUUM PAINTING APPARATUS

BACKGROUND OF THE INVENTION

1. Field of the Invention

The present invention relates generally to a new and improved apparatus for vacuum painting strip materials, and specifically, to a new and improved vacuum painting apparatus having a continuous feed of strip materials to be painted.

2.Description of the Prior Art

It is known in the prior art, for example, in the U.S. Pat. No. 3,084,662 to Afton C. Badger, to provide an apparatus having a continuous feed and which uses vacuum technology.

The basic principle of the Badger-type coating system involves the confinement of a mass of coating material in an application chamber above which a vacuum is formed so that a continuous flow of air will be induced into the coating chamber around the periphery of units of strip material positioned within entrance and exit ports, to remove excess amounts of coating material on surface portions of units of strip material exiting the chamber, and at least partly to dry the coating on the exiting surfaces. The Badger system produces a finished coating that is very uniform and, with certain coating materials, nearly dry.

Since the introduction of the Badger coating concept, some minor improvements have been made in the technology, including utilizing sliding gates at the entrance and exit ports of the application chamber to expedite the changing of entrance and exit port dimensions. However, after the positions of these sliding gates are adjusted, they are held rigidly in the adjusted position to provide exit and entrance ports of fixed dimensions. Fixed entrance and exit port dimensions would be satisfactory if the dimensions of strip material being conveyed through the coating chamber were always constant. As is well known, many types of strip material, particularly fencing lumber strips and the like, have dimensions which can vary substantially from strip to strip. Where such variations in strip material dimensions are encountered, the use of rigidly fixed entrance and exit port dimensions can result in an oversize unit binding up in the application chamber.

More importantly, the Badger coating system technology relies on maintaining a small air gap between surface portions of units of strip material and the sides of the exit port so that accurate, uniform control over the thickness and the integrity of the coating on the strip material can be maintained. Obviously, units of strip material having dimensions substantially larger than normal would at least have one surface touch one of the edges of the exit port marring the coating on the touching surface. This marring is particularly undesirable where the coating is a finish coat of paint and is especially objectionable if marring occurs on the top surface of the board due to contact with the top edge of the exit port.

In another prior art patent, U.S. Pat. No. 4,333,417 to Neal H. Camp, et al, there is provided a vacuum painting system which uses a dimensional sensing feature to adjust one of the exit port gates to accommodate variations in the size of the object to be painted. The Camp, et al patent also provides a masking element within the chamber for preventing the application of coating to at least a part of one surface of a unit of strip material passing through the chamber.

However, neither of these patents exemplary of the prior art takes into consideration, or compensates for, the fact that most strip materials will have a bend or twist along their lengths which could cause a binding of the strip material in the entry and exit ports if not accounted for. Moreover, neither of those prior art patents takes into consideration that the apparatus should avoid wiping of the painted surfaces, other than by making the entry and exit ports larger.

It is therefore the primary object of the present invention to provide a new and improved vacuum painting apparatus which compensates for bending or twisting of the strip material being continuously fed into the apparatus.

It is another object of the present invention to provide a new and improved vacuum painting apparatus which substantially eliminates any wiping of the painted surfaces.

SUMMARY OF THE INVENTION

The primary object of the invention is accomplished by the provision of a vacuum painting apparatus which allows the entry and exit ports to move with respect to the paint chamber, thereby compensating for bending or twisting of the strip material being painted.

Another object of the invention is accomplished by using roller guides at the exit port which are totally withint the paint chamber, and which guides are aligned to eliminate substantially all wiping of the painted surfaces.

BRIEF DESCRIPTION OF THE DRAWINGS

These and other objects, features and advantages of the present invention will become apparent from the detailed specification read in conjunction with the drawings in which:

FIG. 5 is a sectional, top plan view, partly in cross section, of the paint chamber portion of the apparatus according to the present invention, taken along the sectional lines 5—5 of FIG. 3;

FIG. 6 is a sectional view of a portion of the sliding seal in accordance with the present invention, taken along the sectional lines 6—6 of FIG. 5;

FIG. 7 is a pictorial view, in elevation, of the entry port to the paint chamber in accordance with the invention;

FIG. 8 is a side elevational view, partly in cross section, of a pair of guide rollers used in conjunction with the entry port to the paint chamber, taken along the sectional lines 8—8 of FIG. 7;

FIG. 9 illustrates a sequential view of the apparatus illustrated in FIG. 8, subsequent to the strip material passing through the guide rollers;

FIG. 10 is a pictorial view, in elevation, of the exit port from the paint chamber in accordance with the invention;

FIG. 11 is a side elevational view, partly in cross section, of a pair of guide rollers used in conjunction with the exit port of the paint chamber, taken along the sectional lines 11—11 of FIG. 10;

FIG. 12 is an end elevational view, partly in cross section, of the guide rollers in accordance with the invention, taken along the sectional lines 12—12 of FIG. 11;

DESCRIPTION OF THE PREFERRED EMBODIMENT

Figure 1:
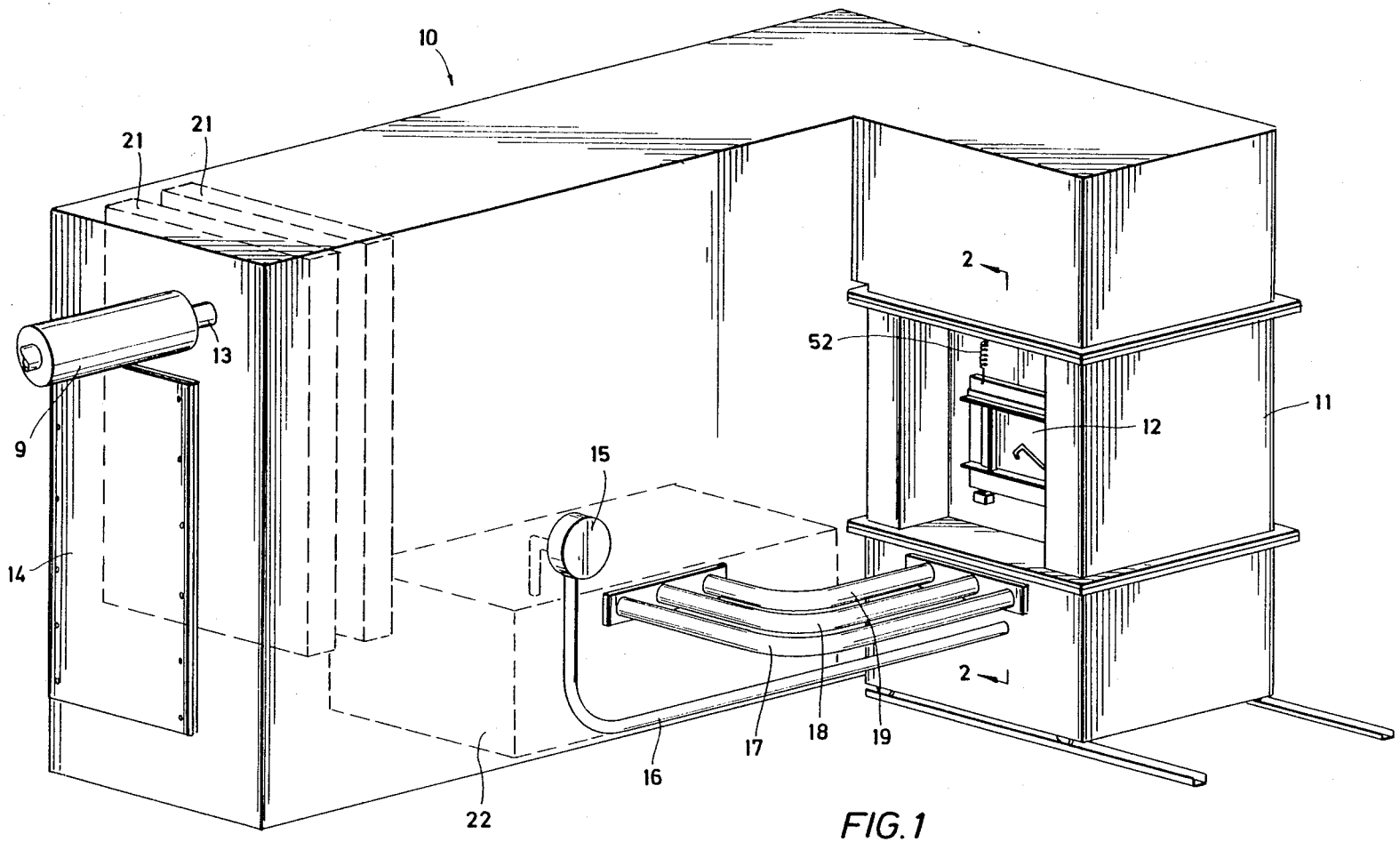
FIG. 1 is an isometric, pictorial view of the vacuum painting apparatus according to the present invention.

Referring now to FIG. 1 in more detail, there is illustrated the vacuum painting apparatus 10. Since the principles of vacuum painting technology are well known in the art, for example, as set forth in the aforementioned Badger patent, those principles need not be discussed in depth herein. Such a system generally includes a paint application chamber 11 and having an inlet port 12 and an exit port, not illustrated in this figure. The apparatus 10 has a vacuum line 13 connected to a conventional vacuum pump 9. A door 14 provides access to the interior of the apparatus 10. A pump 15 provides a supply of paint or other coating material through the line 16, all in a conventional manner, through the paint reservoir 20, in the lower section of the chamber 11, reservoir being illustrated in FIGS. 2 and 3. The apparatus 10 also includes a series of baffles 21. The pump 15 draws its paint from a holding tank 22. Whenever the reservoir 20 becomes too full, it empties back into the holding tank 22 through the return lines 17, 18 and 19.

In the conventional Badger-type of vacuum painting system, the vacuum line 13 creates a pressure differential between the interior and exterior of the application chamber 11. The vacuum induced in the upper part of the application chamber causes air to be introduced through the templates located in the entry port 12 and in the exit port (not illustrated in this figure). This stream of air seals the entrance and exit ports against any loss of paint and provides a continual exchange of paint within the application chamber 11. Due to the baffling arrangement of the series of baffles 21, the majority of the paint entrained in the air flow is deposited on the walls of the baffles 21 and drips back into the holding tank 22. This operation described so far is conventional and, is described at depth in the aforementioned Camp et al patent, specifically with respect to FIGS. 1 and 2 of that patent. Therefore, FIGS. 1 and 2 of U.S. Pat. No. 4,333,417 and the descriptive material in said patent relating to FIGS. 1 and 2 are incorporated herein by reference.

Figure 2:
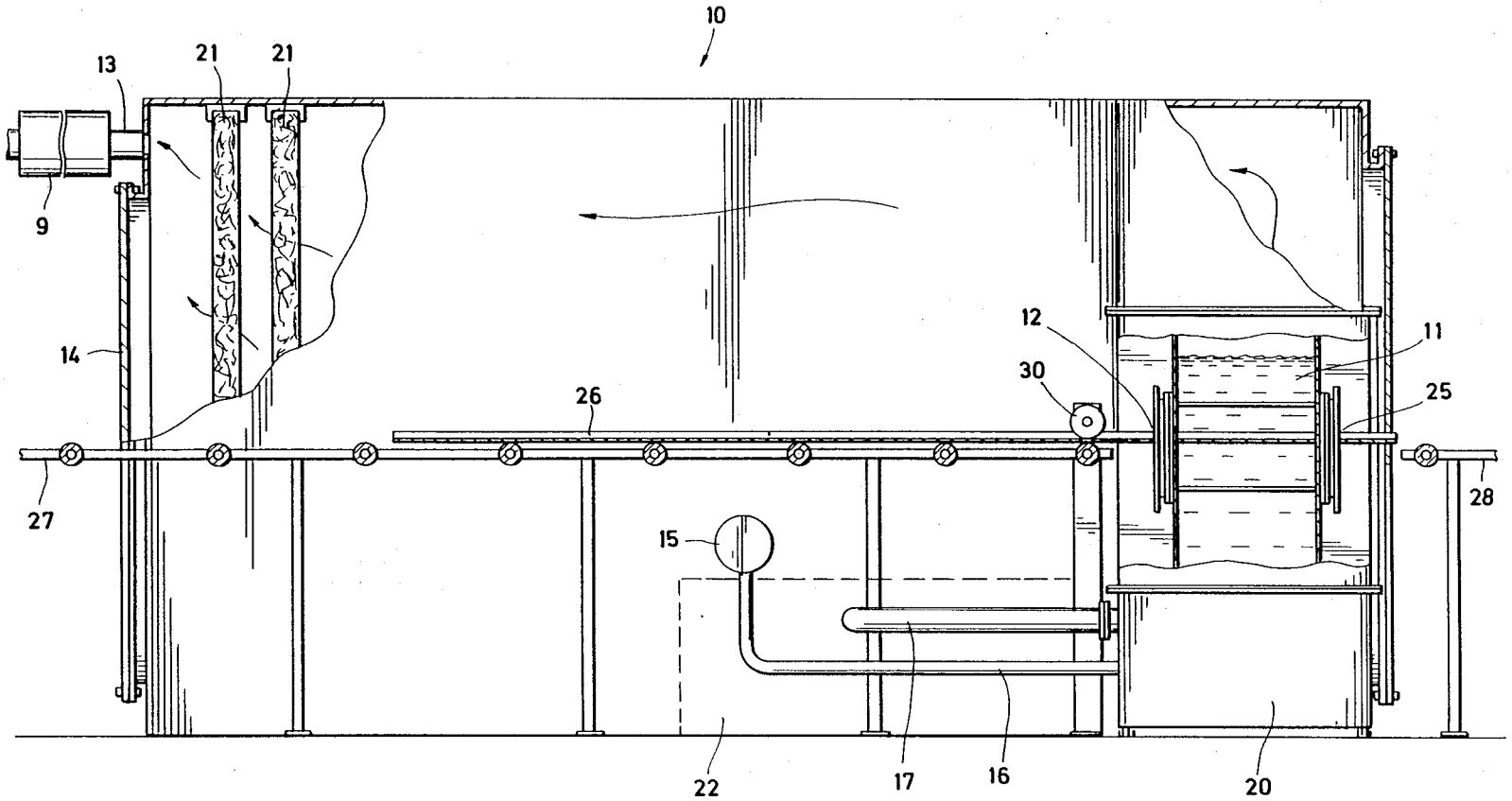
FIG. 2 is a schematic, elevational view, partly in cross section, of the apparatus according to the present invention, illustrated in conjunction with a conveyor belt used to continuously feed strip material into the paint chamber of the apparatus.
Figure 3:
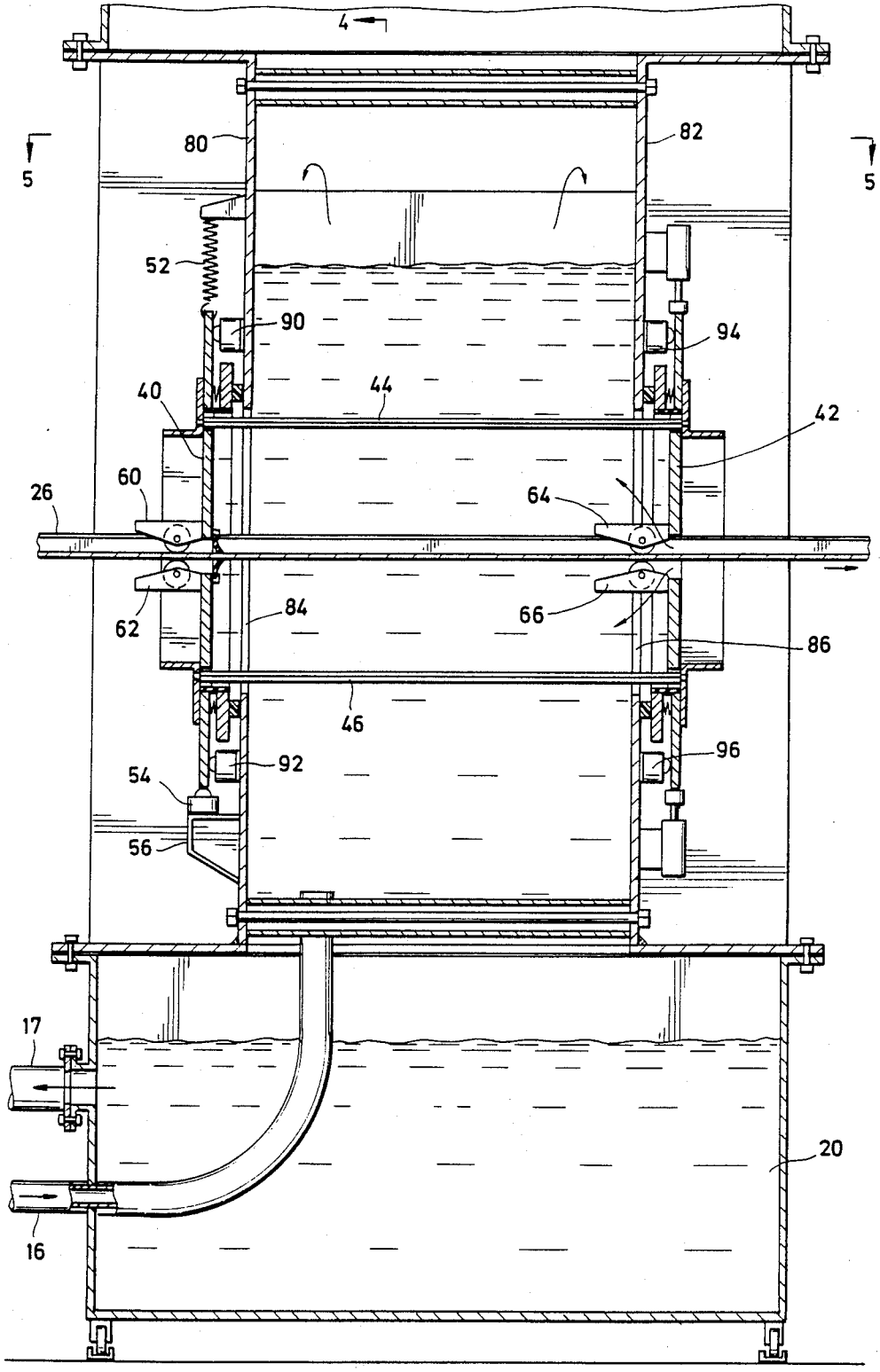
FIG. 3 is an elevational view, partly in cross section, of the paint chamber portion of the apparatus according to the present invention, taken along the sectional lines 2—2 of FIG. 1.

Referring now to FIG. 2, the application chamber 11 is shown as having an inlet port 12 and an exit port 25. A length of strip material 26 is carried by a conventional conveyor belt 27 and is picked up by another conventional conveyor belt 28 upon leaving the application chamber 11 through exit port 25. A set of pinch guide rollers 30 associated with the conveyor belt 27 help guide the strip material 26 into the entry port 12.

Figure 4:
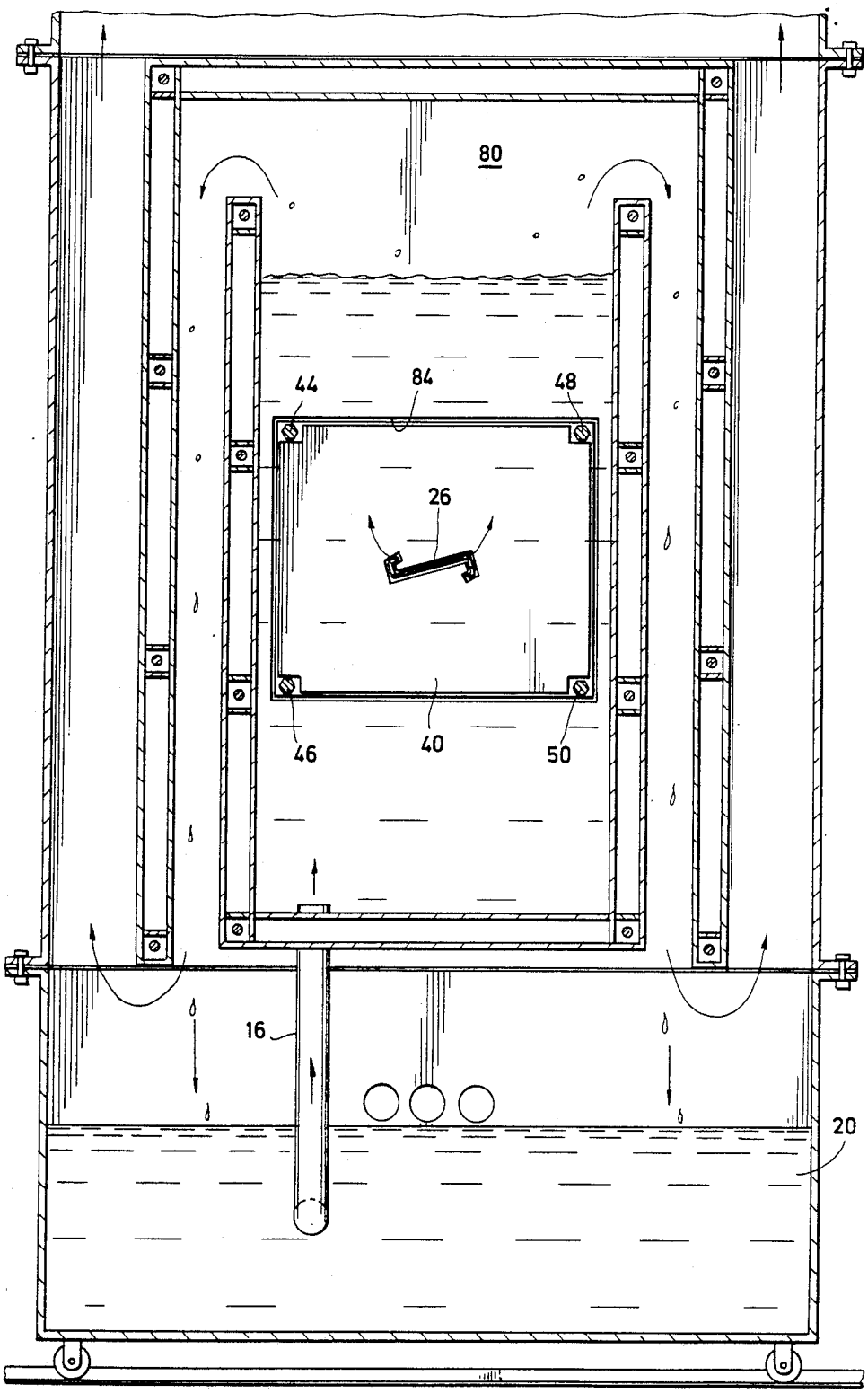
FIG. 4 is a sectional view, in elevation and partly in cross section, of the paint chamber portion of the apparatus according to the present invention, taken along the sectional lines 4—4 of FIG. 3.

Referring now to FIGS. 1, 3, 4, 5, 7 and 10, the application chamber 11 is illustrated in greater detail. The entry template 40 and the exit template 42 are joined together by the two compression struts 44 and 46 and by two other compression struts (not illustrated in this figure). The four struts are parallel to each other. The cross-sectional views of the four struts 44, 46, 48 and 50 are illustrated in FIG. 4.

The template 40 is supported by a pair of springs 52 at its upper end. Its lower end has a pair of roller balls 54 which can roll on angle iron supports 56. Exterior to the template 40 is mounted a pair of roller guide 60 and 62 which control the strip material 26 after it travels past the pinch rollers 30 of FIG. 2. For ease of illustration, only a single pair of entry roller guides 60 and 62 are shown, leading to a single opening in the template 40. In the actual apparatus, the opening in the templates 40 and 42 may be "Z" shaped (FIG. 14) or "C" shaped (FIG. 15) or any shape desired, and a plurality of pairs of guide rollers are used around the periphery of the openings in templates 40 and 42, for example, as illustrated schematically in FIG. 7 by the reference numerals 120, 121, 122, 123, 124 and 125, to guide the strip material being painted.

A second pair of guide rollers 64 and 66 are mounted on the interior of the exit template 42. The template 42 is supported at its upper end by a pair of springs 72 and at its bottom and sides by three hydraulic or pneumatic shock absorber devices 73, 74 and 75 (see FIG. 10). A fourth such device 76 is used at the top in conjunction with the springs 72. If desired, the hydraulic device 74 can be replaced with roller balls on angle iron as illustrated with respect to the entry template 40.

The walls 80 and 82 each have a square opening 84 and 86, respectively, sized such that the compression struts 44, 46, 48 and 50 will fit in the two openings, with some room to spare, such that the two templates 40 and 42 can move with respect to the walls 80 and 82. Two roller balls 90 and 92 are mounted on the wall 80 and roll against the interior of template 40. Two roller balls 94 and 96 are mounted on wall 82 and roll against the interior of template 42. It should be appreciated that the roller balls can, instead, be mounted on the interior of the templates 40 and 42 and thus roll around on the exterior of walls 80 and 82, if desired. As will be explained hereinafter with respect to FIGS. 6 and 13, a sliding seal is provided around the periphery of the openings 84 and 86 to help contain the paint in the application chamber.

Referring now to FIG. 6, there is illustrated a seal structure having a first Teflon sealing member 100, which is essentially a square, doughnut-shaped device bolted to the wall 80 by the threaded bolt 101. The sealing member 100 surrounds the opening 84. A metallic square doughnut member 102, also surrounding the opening 84, is connected to the template 40 by the bolt 103, whose head has a degree of freedom within the cavity 105 in the template 40. The bolt 103 is threadedly attached to the member 102. An L-shaped bracket 106 is secured to the template 40 by the threaded bolt 107 to cover the cavity 105. A spring 108 surrounds the bolt 103 and tends to spring-load the sealing effect by causing the member 102 to be forced against the sealing member 100. A second rubber sealing member 110 is attached at its end 111 to the template 40, while its other end 112 fits loosely against the member 102. The sealing member 110 is a square, doughnut-shaped rubber element which, together with the sealing element 100, coupled with the vacuum created inside the application chamber, prevents any substantial leakage of paint from the application chamber 11 to the exterior of the apparatus.

Referring to FIG. 8, the pair of entry port guide roller assemblies 60 and 62 are illustrated in greater detail. The assembly 60 and the assembly 62 together form a converging angle from a mouth 130, which have the two rollers 132 and 134 at the apex of that angle, and then form a diverging angle away from the rollers 132 and 134. The edges of rollers 132 and 134 are spaced to allow the strip material to pass therebetween. The opening 140 in the template 40 is covered by a two-piece rubber flap 141 bolted to the template by bolts 142 and 143, using two metal flanges 144 and 146, respectively. The rubber flap 141, used only on the entry port, also helps to prevent leakage of the paint from the application chamber.

FIG. 9 illustrates the strip material 26 passing through the assembly illustrated in FIG. 8. It is preferable to use the rubber flap 141 only on the entry port. The use of such a flap on the exit port would tend to wipe paint off the surfaces of the strip material 26.

Referring now to FIGS. 11 and 12, the pair of exit port guide roller assemblies 64 and 66 are illustrated in greater detail. The assemblies 64 and 66 are identical to the assemblies 60 and 62 illustrated in FIGS. 8 and 9. However, the diverging surfaces 150 and 152 are positioned such that their respective end points 151 and 152 are within the projection of exit opening 154 by approximately 1/32". Thus, if the trailing edge of the strip material 26 tends to ride along either of the surfaces 150 or 153, it should still not touch or be wiped by the template 42. This feature could be used with the entry port, but is not considered necessary because paint wiping is generally not a problem other than at the point of exit. For that same reason, the rubber flap 141 used at the entry port in FIGS. 8 and 9 is not used at the exit port illustrated in FIGS. 10 and 11.

Figure 13:
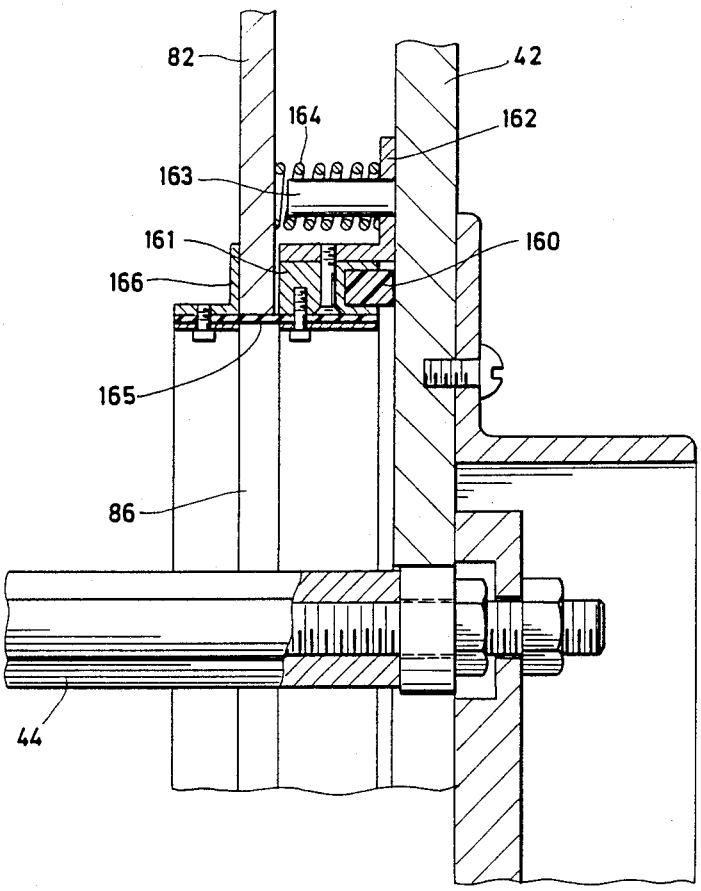
FIG. 13 is an elevated view, partly in cross section, of an alternative embodiment of the sliding seal used with the present invention.

Referring now to FIG. 13, there is illustrated an alternative embodiment to the sliding seal arrangement illustrated in FIG. 6. A square doughnut-shaped Teflon seal member 160 is embodied in a metal, square doughnut block 161, which in turn is bolted to an L-shaped flange 162 attached to the template 42. A pin 163 protrudes from the flange 162 to retain a spring 164. The spring 164 rides the pin 163 between the flange 162 and the wall 82. A second rubber seal member 165, also made as a square doughnut to fit inside the opening 86 in the wall 82, is bolted to the block 161 and also to another L-shaped flange 166 on the interior of the wall 82. Although not illustrated, there are a total of four flanges, such as flange 162, four pins, such as pin 163, and four springs, such as spring 164, the four sets of flanges, pins and springs being equally spread about the periphery of the opening 86 in the wall 82.

In the operation of the sliding seal arrangement illustrated in FIG. 13, as the template 42 rolls on the wall 82, the combination of the seal member 160 and the seal member 165 preclude any substantial amount of paint from leaking out of the application chamber 11 to the exterior of the apparatus.

It should be appreciated that while FIG. 6 illustrates a sliding seal for the entry port and FIG. 13 illustrates a sliding seal for the exit port, either seal arrangement could be used at either port.

Figure 14:
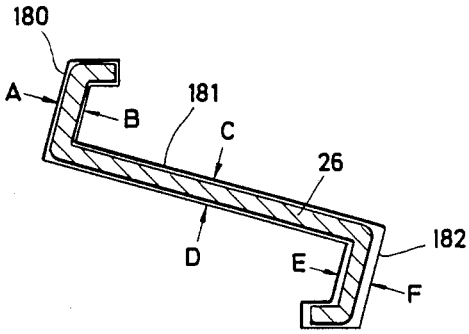
FIG. 14 is an end view of the "Z" template used in accordance with the present invention.

Referring now to FIG. 14, a "Z" opening for use in the templates 40 and 42 is disclosed in greater detail. As illustrated, the end 180 is dimensioned to have a distance AB which is fairly snug with respect to the strip material 26 passing therethrough. Similarly, the web 181 is fairly tight at its dimension CD with respect to the strip material. In contrast, the end portion 182 is less constrained at the dimension DF with respect to the strip material 26. By having a fairly snug fit at one end and at the web, and a loose fit at the other end, there is a much reduced tendency of the strip material to bind up in the opening.

Figure 15:
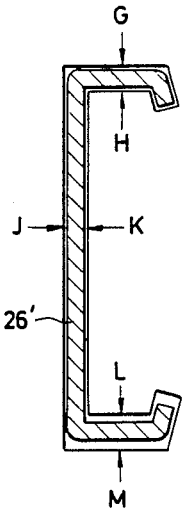
FIG. 15 is an end view of the "C" template used in accordance with the present invention.

FIG. 15 illustrates an example similar to FIG. 14, but with a "C" shaped opening to be used with templates 40 and 42. Thus, the dimensions GH at one end and JK at the web are tight with respect to the strip material 26', whereas the dimension LM at the other end is greater to provide some slack in the fit of the strip material to the opening.

In the overall operation of the apparatus described herein, it should be appreciated that before the strip material 26 enters the entry port guide roller assemblies 60 and 62, the vacuum in the application chamber, coupled with the rubber flap 141 over the entry opening 140 and the sliding seals around the entry and exit ports, causes there to be essentialy no potential for paint leakage other than through the "C" or "Z" shaped exit port 154. However, by keeping the exit port 154 relatively small, the vacuum is able to prevent any paint leakage.

Since the entry and exit templates 40 and 42 are joined together by the four compression struts 44, 46, 48 and 50, the templates 40 and 42 will move as an integral unit. Because of the roller balls 90, 92, 94 and 96, the templates can move about with respect to the walls 80 and 82. For example, the templates can move up, sideways, in a circular path, etc. with respect to the walls 80 and 82. If the hydraulic or air cylinder 74 approach of FIG. 10 is used, the templates can also move down. If the rollers 54 are used, such as is illustrated in FIG. 7, the angle iron 56 represents a limit on the downward movement of the template. Again, it matters not whether the roller balls 90, 92, 94 and 96 are mounted on the walls 80 and 82 and roll against the templates 40 and 42, or are mounted on the templates 40 and 42 and roll agains the walls 80 and 82. In either event, or a combination thereof, there is established a rolling movement between the templates and the walls.

Thus, if the strip material 26 starts to bend or twist, the templates and their respective sets of guide rollers move right with the strip material, creating no binding of the strip material and no delay in the painting process. As the strip material leaves the exit port, there is essentially no wiping of the painted surfaces. Moreover, as the template roll around the surfaces of the walls 80 and 82, the spring-mounted sliding seals around the periphery of the templates help prevent any leakage of paint from the application chamber.

What is claimed is:

1. An apparatus for vacuum painting a strip material, comprising:

an application chamber having first and second opposing walls, each of said walls having an interior surface and an exterior surface, said first wall having a first opening and said second wall having a second opening;

a first template having a third opening smaller than said first opening, said first template being rollably attached to the exterior surface of said first wall, and substantially covering said first opening;

a second template having a fourth opening smaller than said second opening, said second template being rollably attached to the exterior surface of said second wall, and substantially covering said second opening; and a plurality of compression struts joining said first template to said second template.

2. The apparatus according to claim 1 wherein said plurality of compression struts comprises four such struts.

3. The apparatus according to claim 2 wherein said compression struts pass through said first and said second openings in said opposing walls.

4. The apparatus according to claim 3 including in addition thereto, first seal means slidably connected between said first template and the exterior surface of said first wall, and second seal means slidably connected between said second template and the exterior surface of said second wall.

5. The apparatus according to claim 4 wherein each of said first and second seal means is spring-loaded.

6. The apparatus according to claim 1 wherein each of said third and fourth openings is "Z" shaped, each of said third and fourth openings having first and second ends and a web therebetween, the dimensions of each of said first ends being greater than the dimensions of each of said second ends.

7. The apparatus according to claim 1 wherein each of said third and fourth openings is "C" shaped, each of said third and fourth openings having first and second ends and a web therebetween, the dimensions of each of said first ends being greater than the dimensions of each of said second ends.

8. The apparatus according to claim 1 wherein each of said first and second templates has an interior surface and an exterior surface, and including in addition thereto at least one pair of guide roller assemblies mounted on the exterior surfaces of said first template on opposite sides of said third opening, and at least one pair of guide roller assemblies mounted on the interior surface of said second template on opposite sides of said fourth opening.

9. The apparatus according to claim 8 wherein said at least one pair of guide roller assemblies mounted on the interior surface of said second template comprises:

first and second blocks, together forming a converging angle for receiving the strip material being painted and together forming a diverging angle for releasing the strip material being painted; and first and second roller wheels mounted, respectively, in said first and second blocks in opposing relationship to each other.

10. The apparatus according to claim 9 wherein the dimension of said fourth opening is greater than the widest separation of said first and second blocks in providing said diverging angle.

11. A subassembly for use in a vacuum painting apparatus for painting strip material, comprising:

a first template having a first opening for receiving the strip material to be painted;

a second template having a second opening for releasing the painted strip material; and four compression struts connected between said first and second templates, wherein each of said first and second templates has an interior surface and an exterior surface, and including in addition thereto at least one pair of guide roller assemblies mounted on the exterior surface of said first template on opposite sides of said first opening, and at least one pair of guide roller assemblies mounted on the interior surface of said second template on opposite sides of said second opening.

12. The subassembly according to claim 11 wherein said at least one pair of guide roller assemblies mounted on the interior surface of said second template comprises:

first and second blocks, together forming a converging angle for receiving the strip material being painted and together forming a diverging angle for releasing the strip material being painted; and first and second roller wheels mounted, respectively, in said first and second blocks in opposing relationship to each other.

13. The subassembly according to claim 12, wherein the dimension of said second opening is greater than the widest separation of said first and second blocks in providing said diverging angle.

14. A subassembly for use in a vacuum painting apparatus for painting strip material, comprising:

a template having an opening for allowing the strip material to pass therethrough, said template having first and second surfaces; and at least one pair of guide roller assemblies mounted on one of said first and second surfaces of said template on opposite sides of said opening, wherein said at least one pair of guide roller assemblies comprises:

first and second blocks, together forming a converging angle for receiving the strip material being painted and together forming a diverging angle for releasing the strip material being painted; and first and second roller wheels mounted, respectfully, in said first and second blocks in opposing relationship to each other.

15. The subassembly according to claim 14 wherein the dimension of said opening is greater than the widest separation of said first and second blocks in providing said diverging angle.

16. The subassembly according to claim 14 wherein said opening is "Z" shaped and has first and second ends and a web therebetween, the dimensions of said first end being greater than the dimensions of said second end.

17. The subassembly according to claim 14 wherein said opening is "C" shaped and has first and second ends and a web therebetween, the dimensions of said first end being greater than the dimensions of said second end.

* * * * *